United States Patent [19]

Fiel

[11] Patent Number: 4,590,945

[45] Date of Patent: May 27, 1986

[54] GARMENT

[76] Inventor: Christine J. K. Fiel, 6046 Carriage Hill Dr., East Lansing, Mich. 48823

[21] Appl. No.: 695,841

[22] Filed: Jan. 28, 1985

[51] Int. Cl.[4] ..... A41B 9/00; A41C 3/08

[52] U.S. Cl. ..... 128/455; 2/73

[58] Field of Search ..... 128/455, 452, 443, 454; 2/73

[56] References Cited

U.S. PATENT DOCUMENTS

| | | | |
|---|---|---|---|
| D. 260,445 | 9/1981 | Schreiber et al. | D2/2 |
| 1,068,429 | 7/1913 | Heimlich | 2/73 |
| 1,351,437 | 8/1920 | Oppenheimer | 2/73 |
| 1,831,607 | 10/1930 | Ruse | 2/73 |
| 2,009,620 | 8/1934 | Jackson | 2/73 |
| 2,093,192 | 9/1937 | Fine | 2/73 |
| 2,231,559 | 2/1941 | Cadoris | 2/73 |
| 2,290,954 | 5/1941 | Fox | 2/71 |
| 2,318,771 | 5/1943 | Friedman | 2/73 |
| 2,319,779 | 5/1943 | Kidder | 2/73 |
| 2,343,974 | 3/1944 | Hayward | 128/455 |
| 2,551,612 | 5/1951 | Kunstadter | 2/73 |
| 2,595,139 | 4/1952 | Hart | 2/73 |
| 2,703,884 | 3/1955 | Roth | 2/73 X |
| 2,907,331 | 10/1959 | Friedman | 128/454 |
| 3,316,915 | 5/1967 | Howell | 2/73 |

*Primary Examiner*—Doris L. Troutman

*Attorney, Agent, or Firm*—Miller, Morriss & Pappas

[57] ABSTRACT

A garment for female wear is provided with a resilient integrally formed seamless polyester fiberfill bust cup assembly which defines spaced-apart integrally formed breast-receiving cups therein. Side panels are attached to each end of the bust cup assembly. The side panels are cut on a bias so as to take advantage of the natural stretch of the fabric. A back bodice is attached to each of the side panels so as to complete the encirclement of the body of the wearer. The back bodice panel is also cut on a bias so as to take advantage of the natural stretch of the fabric. A front skirt panel is attached at its upper edge to the lower horizontal edge of the bust cup assembly. A back skirt panel is attached at its upper edge to the lower edge of the back bodice panel. The front skirt panel and the back skirt panel are sewn together at their corresponding vertically oriented longitudinal edges so as to complete the encirclement of the body of the wearer. In another embodiment of the garment, the back bodice panel and the back skirt panel are replaced by an elongate back garment panel which is sewn at its longitudinal vertically oriented edges to the corresponding edges of the side panel and front skirt panel respectively.

4 Claims, 9 Drawing Figures

GARMENT

This invention relates to a garment for female wear and more particularly to a unique garment which provides gentle shaping to the figure of a woman yet eliminates the need for a brassiere and a separate slip or camisole.

It has heretofore been the accepted practice for a woman to wear a brassiere under most clothing. Further, when wearing a dress or a blouse and skirt, most women will also wear a slip over their brassieres. While some women will eliminate the use of a brassiere and wear only a camisole under their outer garments, the resultant appearance may impart an embarrassingly "naked" look to the wearer, particularly where close fitting outer garments are worn.

Thus, a need has existed for a garment which eliminates the necessity for a woman to wear a brassiere and a slip or a camisole while imparting to her an acceptable and proper appearance.

Another need has existed for an integrally formed garment which provides gentle shaping to the breasts of a woman yet eliminates the need for a brassiere and an ancillary slip or camisole.

A further need has existed for a garment which gives the woman the appearance of wearing a brassiere while freeing her from the binding and creeping of elastic and/or the discomfort of underwiring such as is encountered in the use of a conventional brassiere.

Yet another need has existed for a garment to be used by the percentage of the female population (size 34B or less) which does not require the "support" they are theoretically getting from a brassiere, but do not really need.

It is therefore an object of this invention to provide an integrally formed garment which eliminates the need of wearing a brassiere with a slip or camisole thereover.

Another object of this invention is to provide an integrally formed garment which provides a close comfortable gentle shaping fit without the use of elastic and/or underwiring but which still imparts to the wearer the appearance of wearing a brassiere.

Yet another object of this invention is to provide an integrally formed garment which eliminates the need for wearing a brassiere and which is specifically targeted for use by women whose brassiere size is 34B or less.

Other objects and advantages found in the construction of the invention will be apparent from a consideration of the following specification in connection with the appended claims and the accompanying drawings.

IN THE DRAWINGS

SPECIFIC DESCRIPTION

Figure 1:
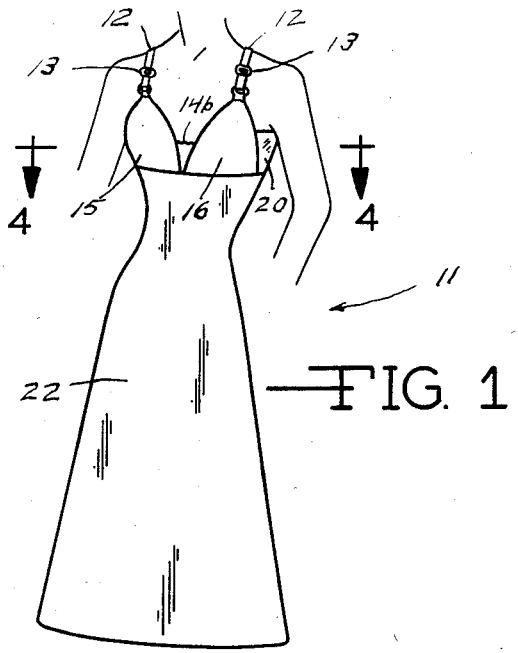
FIG. 1 is a front elevation view, slightly from the side of the garment, embodying the present invention.
Figure 2:
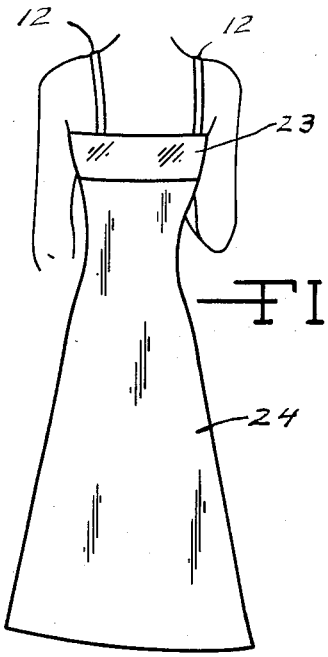
FIG. 2 is a back elevation thereof showing the upper back bodice member cut on a bias to the lower back skirt panel.

As shown in FIGS. 1 and 2, a garment 11 is provided for use by a woman as an undergarment in place of a brassiere and a standard slip or camisole commonly used thereover. The garment is provided with adjustable shoulder straps 12. The shoulder straps 12 are of conventional adjustable configuration, but are characterized by the fact that they do not contain any type of elastic material. Each of the straps 12 is provided with a conventional metal or plastic slide adjuster 13 which is well known in the art and which is used to selectively regulate the length of the straps 12 so as to conform to the shoulders of the wearer.

Figure 5:
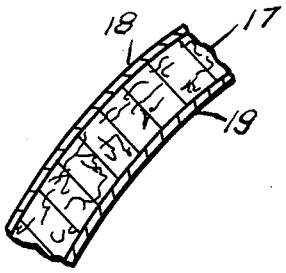
FIG. 5 is a partial cross-sectional view taken on line 5—5 of FIG. 3 and showing the seamless, polyester fiberfill construction of each individual cup member.
Figure 4:
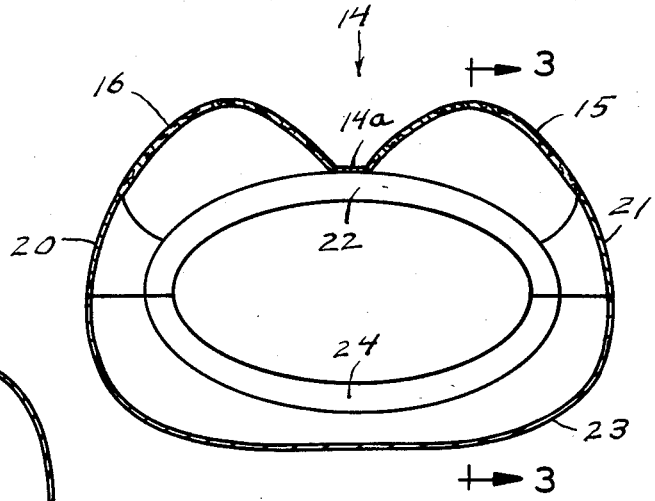
FIG. 4 is a cross-sectional view thereof taken on line 4—4 of FIG. 1 and showing the contours of the smooth, seamless polyester fiberfill cups utilized therein.
Figure 8:
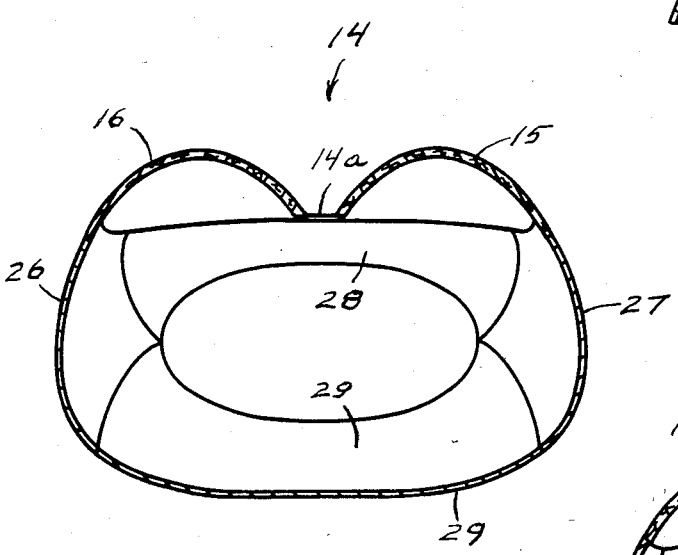
FIG. 8 is a cross-sectional view thereof taken on line 8—8 of FIG. 7 showing the selective spaced-apart configuration of the cup inserts.
Figure 9:
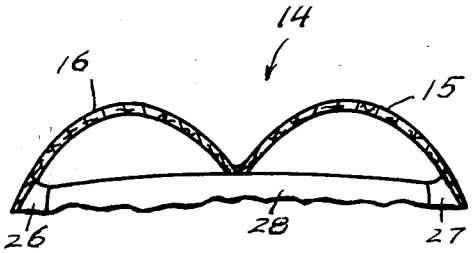
FIG. 9 is a modified schematic sectional view of the embodiment shown in FIG. 8 and showing the individual cup inserts in an abutting integrally formed side-by-side configuration.

A bust cup assembly 14 is provided at the upper portion of the garment 11 so as to receive and lend gentle shaping to the breasts of the wearer. The bust cup assembly 14 comprises separate but integrally formed breast-receiving cups 15 and 16, respectively, as shown in FIGS. 1 and 4. The bust cup assembly 14 is integrally fabricated from a resilient integrally formed seamless, polyester fiberfill material 17 as shown in FIG. 5. It is within the scope of the invention that the breast-receiving cups 15 and 16 are positioned in an abutting relationship to each other as shown in FIG. 9. Alternatively, the breast-receiving cups 15 and 16 are positioned in a spaced-apart relationship as shown in FIGS. 4 and 8. In the spaced-apart configuration shown in FIGS. 4 and 8, the cups 15 and 16 are integrally connected by a fabric strip 14*a*.

The preferred construction of the bust cup assembly 14 is shown in the enlarged cross-sectional schematic view of FIG. 5. In the preferred embodiment of the invention, the fiberfill material 17 is positioned between an outer cloth panel 18 and an inner cloth panel 19 so as to form the individual breast-receiving cups 15 and 16, respectively. However, it is within the scope of the invention, that the resilient integrally formed seamless, polyester fiberfill member 17 be provided with inner and outer integrally formed treated surfaces by methods well known in the art which eliminate the need for the inner and outer cloth panels 18 and 19, respectively.

Figure 3:
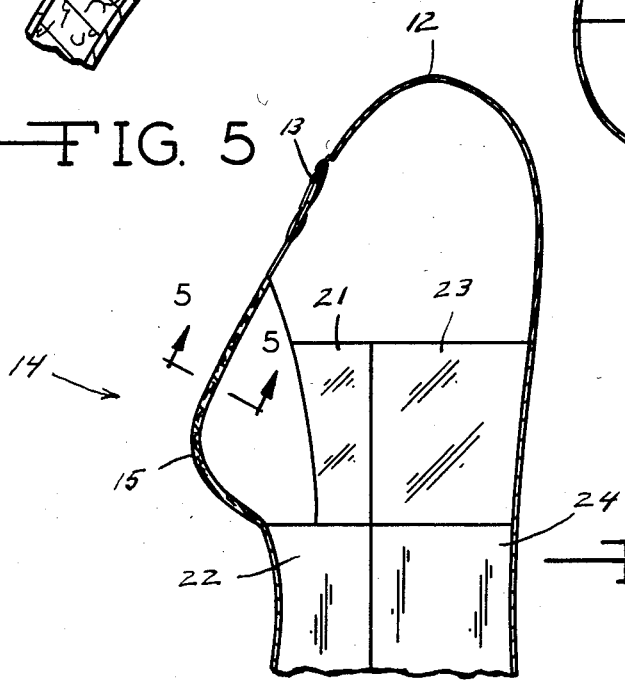
FIG. 3 is a cross-sectional view thereof taken on line 3—3 of FIG. 4 and showing the contours of the smooth, seamless polyester fiberfill cups utilized therein.

As shown in FIGS. 1, 3 and 4, the bust cup assembly 14 is sewn at each end thereof to the side panels 20 and 21, respectively. The side panels 20 and 21 are cut on a bias so as to take advantage of the maximum natural stretch of the fabric used, such as cotton, rayon, nylon, polyester or any other type of fabric, natural or synthetic which is well known in the art.

A small panel 14*b* can be added to the cleavage area which is fabricated from lace or other decorative material so as to make the garment more aesthetically pleasing or can be omitted to achieve a "plunge" neckline effect.

The bottom edge of the bust cup assembly 14 is sewn to the front skirt panel 22. The front skirt panel 22 can be selectively modified in length to meet current fashion needs.

As shown in FIGS. 2, 3 and 4, the upper portion of the garment 11 consists of a back bodice panel 23 which is sewn at each end thereof to the side panels 20 and 21, respectively, so as to complete the encirclement of the body of the wearer by the garment 11. Here again, it is important that the back bodice panel 23 also be cut on a bias for the reasons set forth above.

The lower portion of the garment 11 is completed by a back skirt panel 24 which is sewn at its upper end to the lower edge of the back bodice panel 23 and at its vertical side edges to the corresponding side edges of the front skirt panel 22. The length of the back skirt panel 23 corresponds to the length of the front skirt panel 22.

It is considered to be within the scope of the invention to selectively substitute four or more elongate vertically oriented cloth panels (not shown) in place of the front skirt panel 22 and the back skirt panel 24 so as to impart any desired flared effect to the skirt portion of the garment 11.

Another embodiment of the invention is garment 25 as shown in FIGS. 6 through 9. While garment 25 differs structurally from garment 11 as shown in FIGS. 1 through 5, the following basic concepts are found in both garments 11 and 25:

1. An integrally formed bust cup assembly fabricated from a resilient, seamless fiberfill material as described herein and which is sewn at each end thereof to the side panels.
2. Side and back panels which are cut on a bias for stretch compability.
3. No elastic and/or underwiring used in the garment.
4. Breast-receiving cups defined in the bust cup assembly so as to receive and lend gentle shaping to the breasts of the wearer.
5. The garment lends no support to the wearer, only shaping.

As shown in FIGS. 6 through 9, the modified garment 25 utilizes the same bust cup assembly 14 as is used in garment 11 so as to receive and lend gentle shaping to the breasts of the wearer. The bust cup assembly 14 defines separate but integrally formed breast-receiving cups 15 and 16, respectively.

The bust cup assembly 14 is secured at each end thereof to opposed side panels 26 and 27, respectively. The side panels 26 and 27 are both cut on a bias and at the lower portions thereof are cut so as to gradually narrow to a point so as to merge with the front skirt panel 28 and the back skirt panel 29 as shown in FIGS. 6 and 7.

Figure 6:
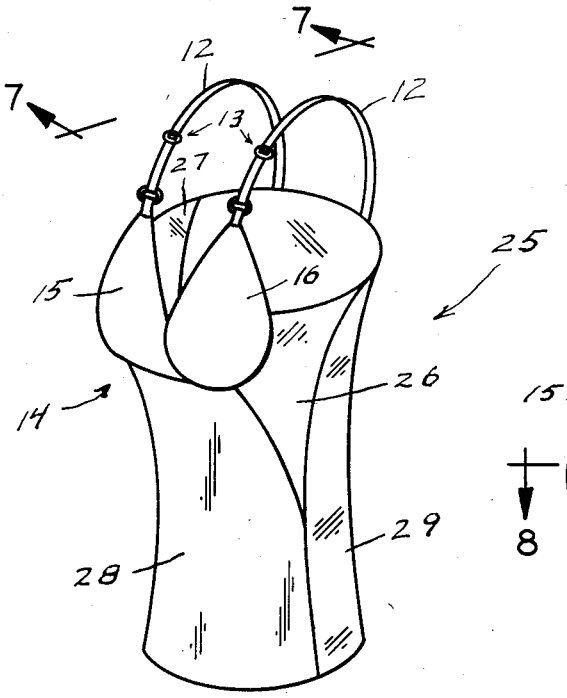
FIG. 6 is a modified embodiment of the garment embodying the present invention wherein the back bodice panel has been eliminated and side panel has been enlarged as shown.
Figure 7:
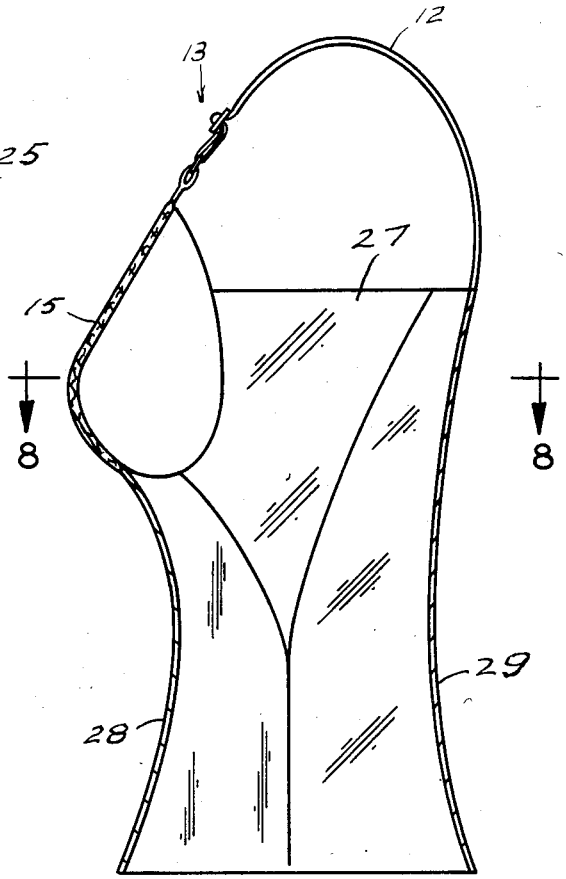
FIG. 7 is a cross-sectional view thereof taken on line 7—7 of FIG. 6.

As shown in FIGS. 6 and 7, the back skirt panel 29 is also cut on a bias and extends the entire length of the garment 25 so as to eliminate the need for the back bodice panel 23 as shown in FIG. 2. The back skirt panel 29 is sewn along the upper vertically oriented longitudinal edges thereof to side panels 26 and 27 and at the lower vertically oriented longitudinal edges thereof to the corresponding vertically oriented longitudinal edges of the front skirt panel below the side panels 26 and 27. The relative positioning of the side panels 26 and 27, the front skirt panel 28 and the back skirt panel 29 greatly enhances the form or close fitting characteristics of the garment in relation to the body of the wearer, particularly in the bust, waist, and hip areas. Here again, the lengths of the front skirt panel 28 and of the back skirt panel 29 can be selectively varied as desired from the camisole-like length shown in FIGS. 6 and 7 to the slip-like length shown in FIGS. 1 and 2, or longer for appropriate evening attire.

It should be noted that it is within the scope of the invention to selectively vary the lateral distance between the breast-receiving cups 15 and 16 as desired to meet the variations encountered in body contours. Thus, the spaced-apart configuration of the breast-receiving cups 15 and 16 is shown in FIGS. 4 and 8. The closely positioned abutting configuration of the breast-receiving cups 15 and 16 is shown schematically in FIG. 9.

It should further be noted that the garment in which this invention is embodied differs significantly from a bra slip in that the instant invention does not utilize elastic or underwiring therein as does the bra slip which is well known in the art. Further, the applicant's garment is not intended to provide a "support" function such as that provided by a brassiere or a bra slip, but is intended to provide a gentle shaping function while giving the appearance that the woman is wearing a brassiere or other foundation garment.

The close fit needed for the applicant's garment is achieved through the manufacturing process whereby the garment is sized corresponding to the sizing of dresses (which establishes girth) (sizes 8, 10, 12, etc.) in addition to the bra and cup size (30B, 32 almost B, 34A, etc.). This dual sizing technique would alleviate the problem of a small busted woman with a large frame having to deal with undesired excess fabric. This dual sizing system for a single garment made possible by the instant invention would offer a wider range of garment sizes from which to choose, thus making it more likely to ascertain and select a woman's true size.

SUMMARY

In summary, as described herein and as shown generally in the drawings, a unique integrally formed garment for female wear is provided which is adapted to lend gentle shaping to the figure of a woman but which eliminates the need for a brassiere. The garment comprises a resilient integrally formed seamless polyester fiberfill bust cup assembly. The bust cup assembly defines a pair of spaced-apart integrally formed breast-receiving cups therein. A side panel is attached to each end of the bust cup assembly. The side panel is cut on a bias so as to take advantage of the natural stretch of the fabric. A back bodice panel is attached to each of the side panels so as to complete the encirclement of the body of the wearer. The back bodice panel is cut on a bias so as to take advantage of the natural stretch of the fabric. A front skirt panel is attached at its upper edge to the lower horizontal edge of the bust cup assembly. A back skirt panel is attached at its upper edge to the lower edge of the back bodice panel. The back skirt panel is attached at its longitudinal vertically-oriented edges to the corresponding longitudinal vertically oriented edges of the front skirt panel so as to complete the encirclement of the body of the wearer.

A modified embodiment of the foregoing garment is provided within four or more flared skirt panels are substituted for the front skirt panel and the back skirt panel so as to impart a flared appearance to the skirt of the garment.

Another modified embodiment of the invention consists of an integrally formed garment for female wear which is adapted to lend gentle shaping to the figure of a woman but which eliminates the need for a brassiere. The garment comprises a resilient integrally formed seamless polyester fiberfill bust cup assembly. The bust cup assembly defines a pair of spaced-apart integrally formed breast-receiving cups therein. A side panel attached to each end of the bust assembly. The side panels are cut on a bias so as to take advantage of the natural stretch of the fabric. A front skirt panel is attached at its upper edge to the lower horizontal edge of the bust cup assembly. An elongate back garment panel is attached at the upper portions of its longitudinal vertically-oriented edges to each of the side panels and at the lower portions of its longitudinal vertically-oriented edges to the corresponding longitudinal edges of the front skirt panel so as to complete the encirclement of the body of the wearer. The elongate back garment panel is cut on a bias so as to take advantage of the natural stretch of the fabric.

In other embodiments of the garment in which this invention is embodied, each of the integrally formed spaced-apart breastreceiving cups are individually fabricated from seamless polyester fiberfill material and are connected to each other by a narrow intermediate fabric panel.

It is thus seen that a unique garment for women is provided which lends gentle shaping to the breasts of a woman yet eliminates the need for a brassiere and a separate slip or camisole.

Various other modifications of the invention may be made without departing from the principle thereof. Each of the modifications is to be considered as included in the hereinafter appended claims, unless these claims by their language expressly provide otherwise.

I claim:

1. In an integrally formed garment for female wear which is adapted to lend gentle shaping to the figure of a woman but which eliminates the need for a brassiere, the improvement comprising:

a resilient integrally formed seamless polyester fiberfill bust cup assembly, said bust cup assembly defining a pair of spaced-apart integrally formed breast-receiving cups therein;

a side panel attached to each end of said bust cup assembly, said side panel cut on a bias so as to take advantage of the natural stretch of the fabric;

a back bodice panel attached to each of said side panels so as to complete the encirclement of the body of the wearer, said back bodice panel cut on a bias so as to take advantage of the natural stretch of the fabric;

a front skirt panel attached at its upper edge to the lower horizontal edge of said bust cup assembly; and a back skirt panel attached at its upper edge to the lower edge of said back bodice panel, said back skirt panel attached at its longitudinal vertically-oriented edges to the corresponding longitudinal vertically oriented edges of said front skirt panel so as to complete the encirclement of the body of the wearer.

2. In the garment of claim 1 wherein four or more flared skirt panels are substituted for the said front skirt panel and said back skirt panel so as to impart a flared appearance to the skirt of said garment.

3. In an integrally formed garment for female wear which is adapted to lend gentle shaping to the figure of a woman but which eliminates the need for a brassiere, the improvement comprising:

a resilient integrally formed seamless polyester fiberfill bust cup assembly, said bust cup assembly defining a pair of spaced apart integrally formed breast-receiving cups therein;

a side panel attached to the end of said bust cup assembly, said side panels being cut on a bias so as to take advantage of the natural stretch of the fabric;

a front skirt panel attached at its upper edge to the lower horizontal edge of said bust cup assembly; and an elongate back garment panel attached at the upper portions of its longitudinal vertically-oriented edges to each of said side panels and at the lower portions of its longitudinal vertically-oriented edges to the corresponding longitudinal edges of said front skirt panel so as to complete the encirclement of the body of the wearer, said elongate back garment panel being cut on a bias so as to take advantage of the natural stretch of the fabric.

4. In the garments of claims 1 and 3 wherein each of said integrally formed spaced-apart breast-receiving cups are individually fabricated from seamless polyester fiberfill material, said spaced-apart breast-receiving cups being connected by a narrow intermediate fabric panel.

* * * * *